United States Patent [19]

Clements

[11] Patent Number: 4,600,328

[45] Date of Patent: Jul. 15, 1986

[54] MASCARA APPLICATOR

[76] Inventor: Brenda Clements, Rte. 4, Box 34, Cordele, Ga. 31015

[21] Appl. No.: 787,133

[22] Filed: Oct. 15, 1985

[51] Int. Cl.[4] ..... A46B 11/00; A45D 40/26

[52] U.S. Cl. ..... 401/129; 401/118; 401/17; 401/18; 132/85; 132/88.7; 132/88.5; 15/159 A; 15/160

[58] Field of Search ..... 401/17, 18, 35, 118, 401/129, 122, 126; 132/34, 85–88.7; 15/164, 159 A, 159 R, 160, 106, 206, 157 A, 157 R; D28/7

[56] References Cited

U.S. PATENT DOCUMENTS

| | | | |
|---|---|---|---|
| 1,143,629 | 6/1915 | Hughes | 401/18 X |
| 1,811,205 | 6/1931 | Lee | 15/160 X |
| 2,554,335 | 5/1951 | Kollsman | 401/35 |
| 2,624,062 | 1/1953 | Knoderer | 15/106 |
| 2,629,121 | 2/1953 | Petre | 15/160 X |
| 2,929,085 | 3/1960 | Resnick | 15/206 |
| 3,093,113 | 6/1963 | Reynoso | 401/35 |
| 3,480,371 | 11/1969 | Lee | 401/118 |
| 3,870,186 | 3/1975 | Reinhard | 401/129 |
| 3,908,676 | 9/1975 | Levine et al. | 132/88.7 |
| 3,921,650 | 11/1975 | Montgomery | 132/88.7 |
| 3,998,235 | 12/1976 | Kingsford | 132/88.5 |
| 4,165,755 | 9/1979 | Cassai | 132/88.7 |
| 4,461,312 | 7/1984 | Gueret | 132/88.7 |

FOREIGN PATENT DOCUMENTS

| | | | |
|---|---|---|---|
| 1158602 | 12/1983 | Canada | 401/129 |
| 3240152 | 5/1984 | Fed. Rep. of Germany | 401/129 |
| 2489753 | 3/1982 | France | 401/18 |
| 7810153 | 5/1979 | New Zealand | 15/206 |

*Primary Examiner*—Richard J. Apley
*Assistant Examiner*—Alfedo D. Acoff
*Attorney, Agent, or Firm*—Thomas & Kennedy

[57] ABSTRACT

A mascara applicator has a container formed with two cells and two brushes that have bristles configured as oppositely oriented cones.

7 Claims, 4 Drawing Figures

MASCARA APPLICATOR

TECHNICAL FIELD

This invention relates generally to devices for applying cosmetics, and particularly to applicators for applying mascara to eyelashes.

BACKGROUND OF THE INVENTION

Mascara applicators today typically comprise a tubular container that contains a supply of mascara, and a slender brush having a cap on one end that provides a handle which may be threaded upon the neck of the container with the brush located within the mascara. In use, the cap on the end of the brush is unscrewed from the container neck and the brush removed bearing a supply of mascara on its bristles. The user may then stroke the mascara laden bristles upon her eyelashes and upon completion of the application replace the brush back with its bristles housed within the container and its supply of mascara. Exemplary of such mascara applicators are those shown in U.S. Pat. Nos. 3,908,676, 3,998,235, 3,921,650, 3,998,235, 4,165,755 and 4,461,312.

Advances made recently in the design of mascara applicators have resulted from a continuing need to improve the ease and effectiveness by which mascara may be applied to eyelashes. As this art has matured efforts have been made to provide applicators by which mascara may be distributed evenly to both left and right eyelashes and homogeneously to eyelashes of varying densities, fineness and shapes. Thus, some applicators have been provided with different peripheral shapes such as conical, cylindrical and oval. Others have provided brushes that have pivot means for reorienting the brush end while others still have included a comb, brush and serrated implements all upon one working end of the applicator to enhance versatility.

Though mascara applicators have now reached a mature state of development they nevertheless are still beset with some problems. For example, since few people are ambidextrous it is commonly desirable to apply mascara with either one's right or left hand to the lashes of both eyes. However, shape and orientation of brush bristles of a single applicator are each normally fixed. Therefore, where their design is well suited for applying mascara to the lashes of one eye with one hand, they are inherently not as well suited for applying mascara with the same hand to the other eye. This is because outside lashes tend to be longer than inside lashes located closer to the nose. Thus, an applicator that has a generally cylindrical, peripheral surface of its brush bristles is better suited for applying mascara to the central portion of the lashes than to the end portions. Where the applicator has a conical shape of bristles, with the apex of the conical mass located at the tip of the brush, the brush is well suited for applying with the right hand mascara to right eyelashes while it is ill suited for applying mascara to the left eye lashes unless a hand switch is made.

In addition, with the just described applicators mascara is applied from a common supply to the lashes of both eyes. As a result any bacteria associated with an illness of one eye, even in an embryonic stage of development before it is recognized, may be transported to the other eye upon the application of mascara from such a common source. As a result a medical problem with one eye is likely to be spread to the other eye in the process of applying the cosmetic. This is one of the reasons why physicians commonly instruct female patients with an eye disease to discard all of their partially used supplies of mascara.

It is thus seen that a need remains for a mascara applicator that would tend to alleviate the just described problems associated with those applicators of the prior art. It is to the provision of such an applicator that the present invention is therefore primarily directed.

SUMMARY OF THE INVENTION

In one form of the invention a mascara applicator comprises a container having two tubular cells adapted to house two portions of mascara in mutual isolation. The applicator also comprises two brushes of a size and shape adapted to be repeatedly inserted into and removed from the container cells. Each of the brushes has a rod formed with bristles along one end and a handle formed on the opposite end. The radial size of the bristles of the two brushes are tapered in opposite axial directions along the rod ends.

In another form of the invention a mascara applicator for applying mascara with the same hand to the lashes of both left and right eyes comprises two brushes having a mass of bristles in the general shape of a cone formed along an end of each brush opposite a handle end. The conical apex of one brush bristle mass is located at the tip of the brush end of one of the brushes while the conical base of the other bristle mass is located at the tip of the brush end of the other brush.

In yet another form of the invention a mascara applicator comprises a rod having a handle end and a brush end and a mass of bristles mounted along the rod brush end of progressively increasing bristle sizes, as measured radially of the rod, as the mass of bristles extend along the brush end away from the handle end.

DETAILED DESCRIPTION

Figure 1:
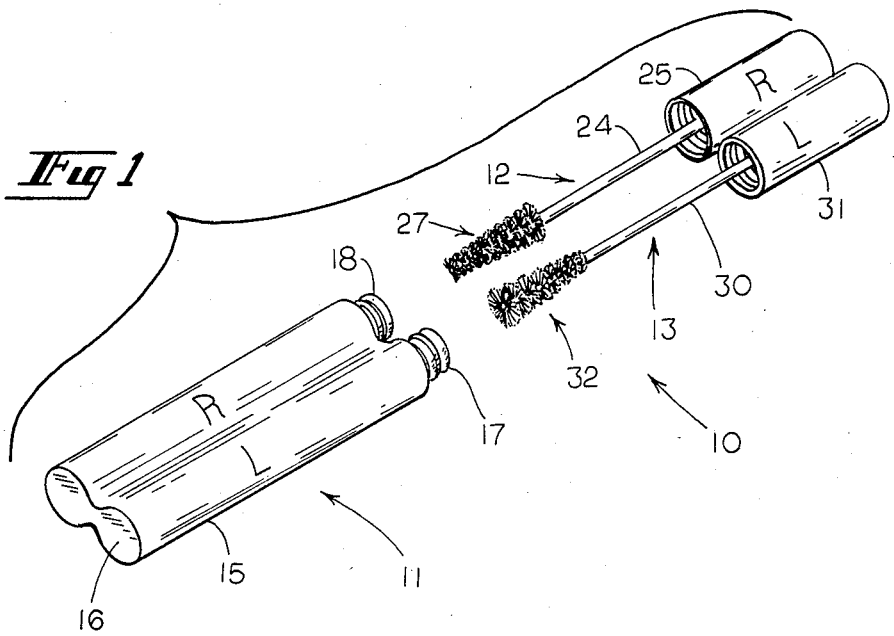
FIG. 1 is a perspective view of a mascara applicator embodying principles of the present invention shown with two brush components removed from a container component of the applicator.
Figure 2:
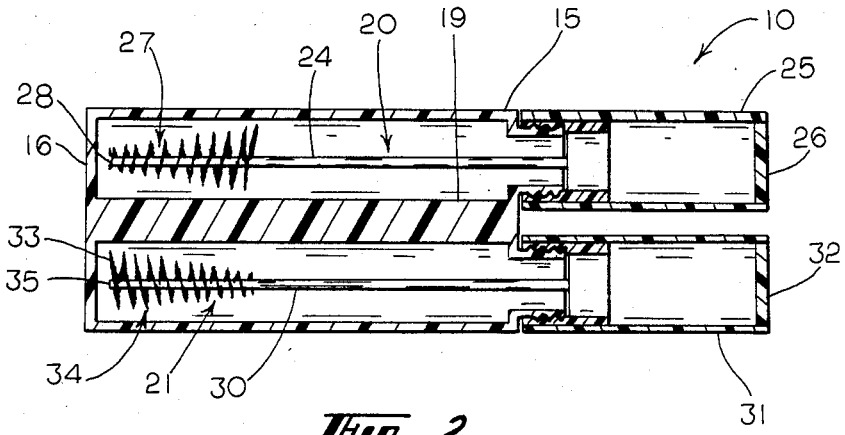
FIG. 2 is a cross-sectional view of the applicator illustrated in FIG. 1 with both brushes shown positioned within the container which is shown empty of mascara for clarity of illustration.

With reference next to the drawing there is shown a mascara applicator illustrated generally at 10 which is comprised of a container 11 and two brushes 12 and 13. The container 11 has a convoluted side wall 15 closed at one end by an end wall 16 and two open ended, threaded necks 17 and 18 disposed in spaced side by side relation at the other end. A central partition 19 is formed within the container so as to bifurcate its interior into two tubular cells 20 and 21. The cell 20 is filled with one unshown supply of mascara while the cell 21 is filled with another, separate unshown supply. The brush 12 has a cylindrical rod 24 which extends from a handle end to which an internally threaded cap 25 is mounted that has sealed an end wall 26. A mass of bristles 27 is mounted to a brush end of the rod 24 located opposite the handle end with the bristles extending radially outward from the rod as a helical tuft. The configuration of the mass of bristles 27 is thus conventional and has a peripheral shape of a cone that has its apex end located at a tip 28 of the rod 24. The other brush 13 is similarly comprised of a cylindrical rod 30 of the same length as rod 24 having a cap 31 mounted to a handle end and sealed by an end wall 32. Again, the brush end of the rod 30 opposite the handle end carries a mass of bristles 32 which again radiate outwardly from the rod in the peripheral shape of a cone. With this brush 13, however, the orientation of the bristle mass is reverse to that of the bristle mass of the other brush 12. In other words, the base end 33 of the cone is located adjacent the rod tip 35 of rod 30. The brush 12 is marked with the letter R to denote right eye while the brush 13 is marked with the letter L to denote left eye. The container is also marked with an R and an L over cells 20 and 21, respectively.

Figure 3:
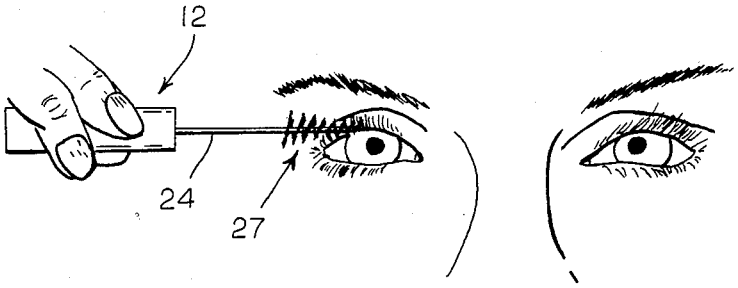
FIG. 3 is an illustration of mascara being applied to the lashes of a right eye with one of the applicator brushes held with the right hand.
Figure 4:
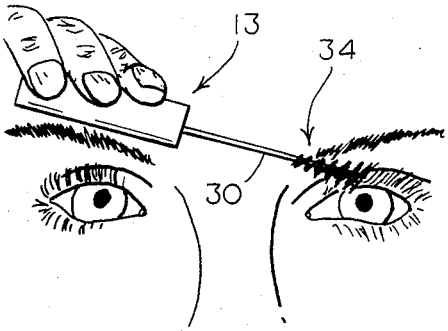
FIG. 4 is an illustration of mascara being applied to the lashes of a left eye with another one of the brushes held with the same right hand.

To apply mascara to eye lashes the brush 12 marked R may be removed from the end of the cell 20, which also is marked for the right eye, and mascara applied to the lashes of a person's right eye with the brush held in the right hand as shown in FIG. 3. Once the application is completed the brush 12 may then be returned into the interior of cell 20 whereupon it is coated with more mascara. Then the brush 13 may be removed from the cell 21, labeled for left eye use, and with it held by the same right hand mascara applied to the lashes of the person's left eye as shown in FIG. 4. Following completion of this application the brush 13 may also be returned to position its bristles within the cell 21 whereupon it becomes coated with more of the cosmetic.

In FIG. 3 it is seen that application is facilitated by the orientation of the mass of bristles 27 which makes it easy to apply mascara evenly to the lashes as they become more lengthy along the outside of the eyelids. Similarly, with brush 13 held in the same right hand the shape and orientation of the bristles 34 facilitate the even application of mascara to the eyelashes of the left eye, which also are longer on the outside of that eye, as shown in FIG. 4. Since each brush is repeatedly stored and removed from the same separate cell of the housing, any bacteria that may be found on the brush or within the supply of mascara housed within its designated cell is not transferred to the other brush, cell or eye. In this manner the likelihood of a transfer of bacteria from one eye to the other is substantially lessened where the applicator is properly used.

It thus is seen that an applicator for applying mascara or other type cosmetic is provided which overcomes problems associated with those of the prior art. It should, however, be understood that the just described embodiment merely illustrates principles of the invention in one preferred form. Many modifications, additions and deletions may be made thereto without departure from the spirit and scope of the invention as set forth in the following claims.

I claim:

1. A mascara applicator comprising a container having two tubular cells adapted to house two portions of mascara in mutual isolation; and two brushes of a size and shape adapted to be repeatedly inserted into and removed from said container cells with each of said brushes having a rod formed with bristles along one end and a handle formed on the opposite end and with the radial size of said bristles of said two brushes being tapered in opposite axial directions along said rod ends.

2. The mascara applicator of claim 1 wherein said bristles are formed as helical tufts along said rod ends.

3. The mascara applicator of claim 1 wherein each of said tubular cells terminates with a threaded tubular neck and wherein each of said brush handles is formed with a cap adapted to be threaded upon one of said necks.

4. The mascara applicator of claim 1 wherein said brushes are of the same length.

5. A mascara applicator for applying mascara with the same hand to the lashes of both left and right eyes, and with the applicator comprising two brushes having a mass of bristles in the general shape of a cone formed along an end of each brush opposite a handle end, and with the conical apex of one bristle mass being located at the tip of said brush end of one of said brushes and with the conical base of the other bristle mass being located at the tip of said brush end of the other of said brushes.

6. The mascara applicator of claim 5 further comprising a container having two cells adapted to house two supplies of mascara in mutual isolation.

7. A mascara applicator for applying mascara with the same hand to the lashes of both left and right eyes, and with the applicator comprising two brushes having a mass of bristles in the general shape of a cone formed along an end of each brush opposite a handle end, and with the conical apex of one bristle mass being located at the top of said brush end of one of said brushes and with the conical base of the other bristle mass being located at the top of said brush end of the other of said brushes, and a container having two cells adapted to house two supplies of mascara in mutual isolation with one of said cells and one of said brushes being marked for right eyelash usage and with the other of said cells and the other of said brushes being marked for left eyelash usage.

* * * * *